US005611535A

United States Patent [19]

Tiberio

[11] Patent Number: 5,611,535

[45] Date of Patent: Mar. 18, 1997

[54] GAMING MACHINE HAVING COMPOUND WIN LINE

[75] Inventor: Dominic Tiberio, Las Vegas, Nev.

[73] Assignee: Bally Gaming International, Inc., Las Vegas, Nev.

[21] Appl. No.: 390,199

[22] Filed: Feb. 17, 1995

[51] Int. Cl.[6] ..... G07F 17/34

[52] U.S. Cl. ..... 273/143 R; 463/20

[58] Field of Search ..... 273/138 A, 143 R, 273/138.2; 463/20, 21

[56] References Cited

U.S. PATENT DOCUMENTS 4,198,052 4/1980 Gauselmann ..... 273/143 R

FOREIGN PATENT DOCUMENTS 2106292 4/1983 United Kingdom ..... 273/138 A

*Primary Examiner*—Benjamin H. Layno

*Attorney, Agent, or Firm*—Jenner & Block

[57] ABSTRACT

A gaming machine has a plurality of symbol-bearing reels which are rotated to place the symbols in visual association with a win line. When the reels are brought to a halt, at least one symbol from each reel is associated with the win line. However, the win line has at least two indicating portions so that on one of the reels, two symbols are associated with the win line. Thus, a displayed game outcome includes at least one symbol from each of the reels and two symbols from one of the reels.

17 Claims, 5 Drawing Sheets

| REEL STOP POSITION (86) | UPPER SYMBOL (88) | MIDDLE SYMBOL (90) | LOWER SYMBOL (92) |
|---|---|---|---|
| 1 | A | B | C |
| 2 | B | C | D |
| 3 | C | D | E |
| 4 | D | E | J |
| 5 | E | J | (BLANK) |
| 6 | J | (BLANK) | J |
| 7 | (BLANK) | J | A |
| 8 | J | A | B |

84

GAMING MACHINE HAVING COMPOUND WIN LINE

FIELD OF THE INVENTION

The invention relates to gaming machines generally, and in particular to techniques for displaying game outcomes in slot machines.

BACKGROUND OF THE INVENTION

Gaming machines include games of chance such as slot machines. The traditional mechanical slot machine includes three or four symbol-bearing reels rotatably mounted on a common axis. The symbols are located on the peripheries of the reels, and are typically pictures of bells, bars, and fruit. There are also "blank" symbols, which are the portions of the reels' peripheries in between the picture symbols. As used herein, "symbols" includes blanks.

The reels are placed behind a glass plate, and are oriented so that their symbol-bearing peripheries face the player. A horizontal win line is etched or painted on the glass plate so that when the reels are at rest, one symbol from each reel is visually associated with the win line. Thus, a "win line" defines the symbols that produce a single game outcome. For example, on a three reel slot machine having a single horizontal win line, the win line defines the three symbols that determine the game outcome. Some machines make use of the fact that more than one symbol from each reel may be visible to the player and therefore have multiple win lines, including both horizontal and diagonal lines. Thus, for example, on a three reel slot machine having three horizontal and two diagonal win lines, five groups of three symbols define five game outcomes, i.e., the player has five different ways to win.

To play the slot machine, the player spins the reels by pulling a handle which is mechanically linked to the reels. As the reels spin, they display a series or progression of symbols along the win line. After a brief period of spinning, each of the reels comes to rest at one of many predetermined and discrete "reel stop positions." At each reel stop position, a particular part of the reel's periphery, i.e., a symbol, is displayed at the win line. The game outcome is the particular combination of symbols displayed at the win line.

In the 1970's, manufacturers developed electronic versions of the traditional mechanical slot machine. In these electronic machines, the reels are computer controlled, and there is no mechanical linkage between the handle and the reels. Instead, when the user pulls the handle, the computer randomly selects reel stop positions for each of the reels, and then sets the reels into motion with a motor. The reels are allowed to spin for a short time, and then are stopped at the selected reel stop positions. In effect, the game outcome is determined by the computer, with the spinning reels used only to display that result. Thus, in some machines, the reels are eliminated altogether, and the game outcome displayed on a video screen. The video display is often a representation or facsimile of spinning reels, to preserve the charm and excitement of the traditional slot machine. To simulate the effect of a spinning reel, the video screen displays a series or progression of symbols, which appear to move past a win line.

When a machine has multiple win lines, each win line is capable of displaying a game outcome. It is possible for the player to select in advance which win line (the "active win line") will indicate the game outcome. Alternatively, several win lines may be active. The more active win lines, the greater the player's chances of obtaining a winning game outcome. This, in turn, increases the player's interest in the game.

One limitation of existing machines (even when multiple win lines are used) is that when the reels are at rest, each win line is associated with only one symbol from each reel. Thus, game outcomes only include combinations of symbols consisting of at most one symbol from each reel.

SUMMARY OF THE INVENTION

To increase player enjoyment, the present invention is a new technique for displaying game outcomes. In accordance with the invention, a gaming machine, such as a slot machine, has a plurality of symbol-bearing reels and a compound win line that is associated with more than one symbol on a single reel. Thus, a winning game outcome can require, for example, a combination that includes two or more particular symbols from a single reel.

In one embodiment, the gaming machine has three symbol-bearing reels. As is conventional, the reels are mounted side by side on a common axis so that their symbol-bearing peripheries face the player. A win line is provided having upper, lower and middle indicating portions. The middle indicating portion extends across all three reels, and the upper and lower indicating portions extend only over the center reel.

During game operation, the reels spin momentarily before coming to rest at selected reel stop positions. When the reels are stationary, the middle indicating portion will be aligned with a symbol from each of the three reels, and in addition the upper and lower indicating portions will each be aligned with an additional symbol from the center reel. Thus, the game outcome defined by the win line can include one symbol from the left reel, one symbol from the right reel and three symbols from the center reel. Therefore, in one embodiment on a three reel slot machine, five symbols determine the single game outcome.

The invention is not limited to this particular configuration. For example, the upper and lower indicating portions could be associated with the left or right reel, instead of the center reel. Also, the win line could have additional indicating portions such that game outcomes could, for example, consist of two or three symbols from both the left and center reels, or for that matter, three symbols from each of the three reels. Moreover, additional portions could be used so that the single game outcome consists of four or more symbols from a particular reel.

DETAILED DESCRIPTION OF THE PREFERRED EMBODIMENT

Figure 1:
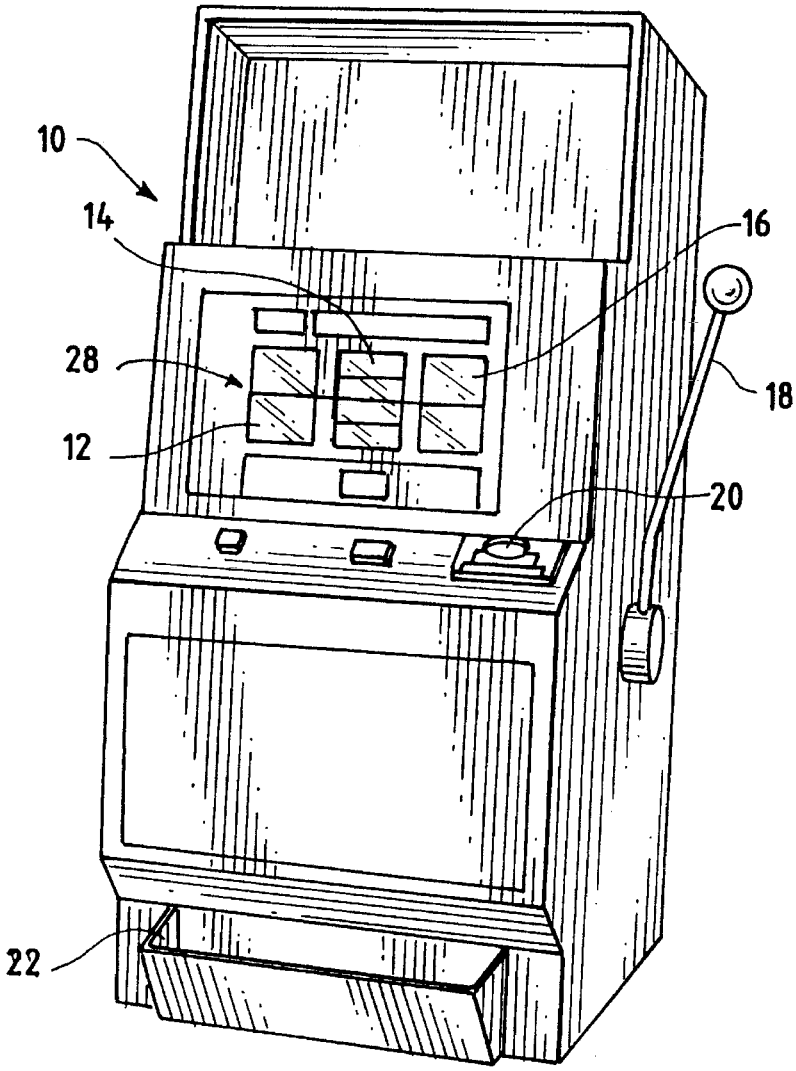
FIG. 1 is a perspective view of an electronic slot machine in which the present invention can be employed.

FIG. 1 is a perspective view of an electronic slot machine 10 in which the present invention can be employed. Suitable slot machines are manufactured by Bally Gaming International, Inc. Slot machine 10 includes left, center and right symbol-bearing reels 12, 14 and 16, which are rotatably mounted on a common axis. Slot machine 10 includes a handle 18, which a player pulls to initiate a game, coin intake slot 20, through which the player inserts coins, and a coin hopper (not shown) which stores coins inside slot machine 10. A coin tray 22 is provided for dispensing a player's winnings.

Figure 2:
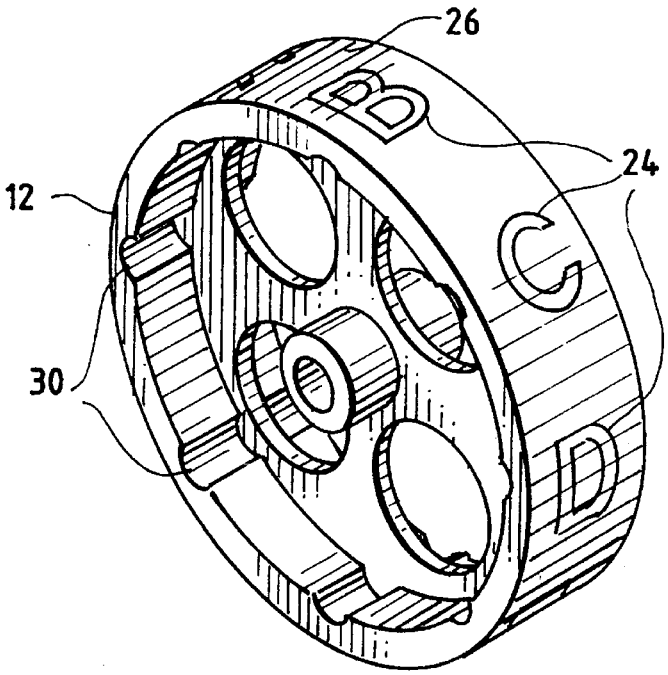
FIG. 2 is a perspective view of a reel from the slot machine of FIG. 1.

Reels 12–16 are substantially identical, although they may vary in terms of the number and placement of symbols, if desired. Representative of the other reels, left reel 12 is shown in FIG. 2. Symbols 24 are located on the periphery 26 of reel 12. As shown in FIG. 1, a win line 28 in accordance with the invention is placed adjacent to the reels, so that when the reels are at rest, symbols from each reel are visually associated with win line 28. Win line 28 is described below in more detail. Each reel's final resting position will be at a predetermined and discrete "reel stop position". At each reel stop position, one or more parts of the reel's periphery, i.e., one or more symbols, are displayed at win line 28. Thus, each reel stop position is associated with a particular symbol. For the purpose of illustration, these reel stop positions are represented as detents 30 in FIG. 2. Not every detent in FIG. 2 is indicated by a reference numeral.

Figure 3:
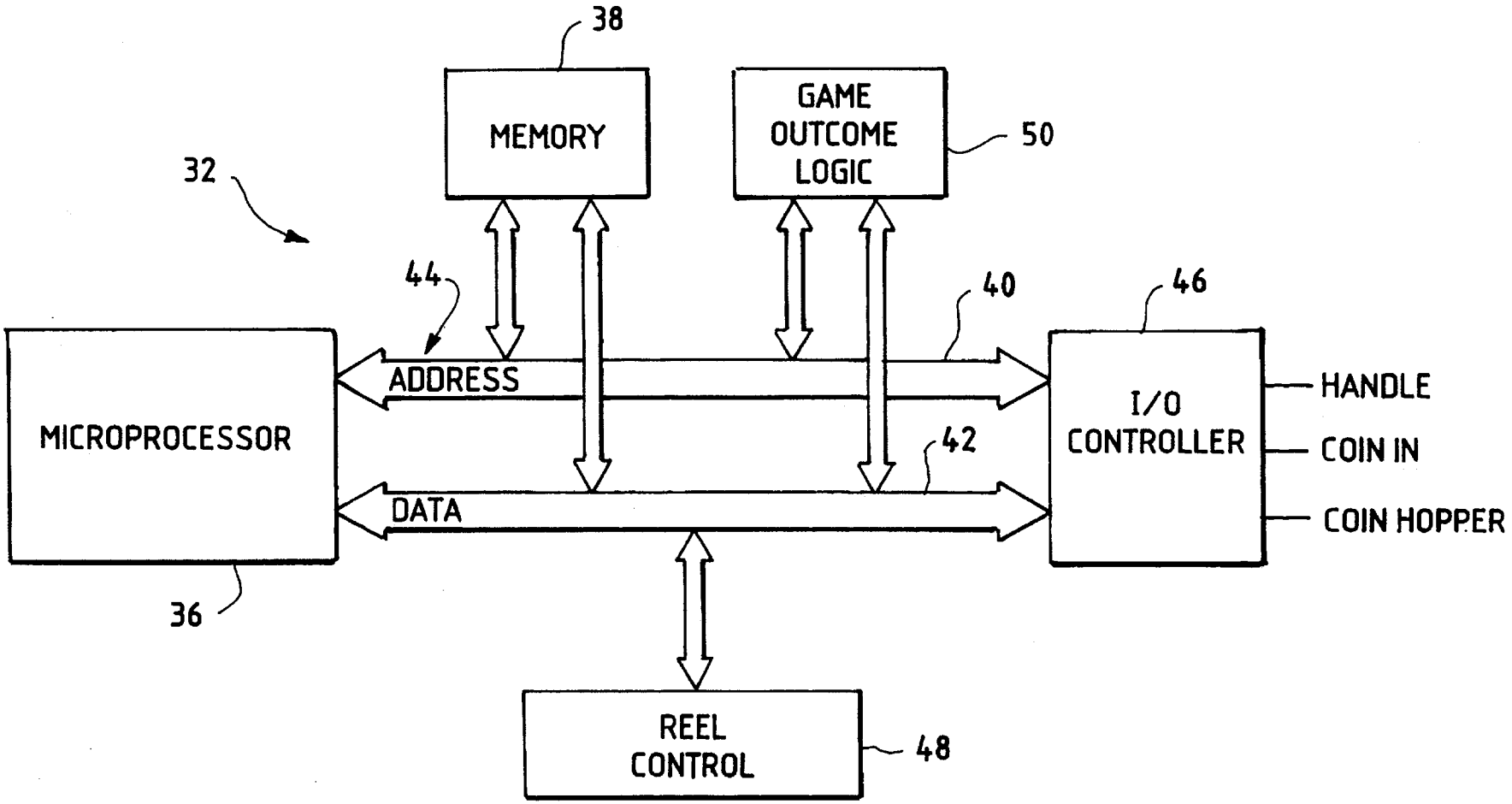
FIG. 3 is a block diagram of the electronic control system of the slot machine of FIG. 1.

FIG. 3 is a block diagram of an electronic system 32 for controlling slot machine 10, which includes game outcome logic in accordance with the invention. The system has a microprocessor 36, which is a Motorola 68000. Microprocessor 36 controls slot machine 10 in accordance with programs and data stored in a memory 38. Memory 38 is coupled to microprocessor 36 by address and data lines 40 and 42, respectively, of bus 44. Also coupled to microprocessor 36 via bus 44 are an input-output controller 46, a reel control mechanism 48 and a game outcome logic circuit 50, the operation of which is described in co-pending U.S. Pat. application Ser. No. 08/234,141 entitled "Gaming Machine Having Electronic Circuit for Generating Game Results with Non-Uniform Probabilities" and filed Apr. 28, 1994 (the disclosure of which is hereby incorporated by reference in its entirety).

Input-output controller 46 provides an interface between microprocessor 36 and various sensors (not shown). One sensor generates a HANDLE signal, indicating when the player has pulled handle 18. Another sensor generates a COIN IN signal indicating when the player has inserted coins into coin intake slot 20. Input-output controller 46 also allows microprocessor 36 to assert a control signal COIN HOPPER which actuates the coin hopper to discharge coins to tray 22.

Game play is initiated when microprocessor 36 detects that a player has inserted a coin and pulled handle 18. Microprocessor 36 then queries a game outcome logic circuit 50, which provides a randomly selected reel stop position for each of the three reels 12–16. The combination of selected reel stops, along with the win line, determines the game outcome. A table in memory 38 associates each possible game outcome with its corresponding payout (which in many cases may be zero).

Microprocessor 36 then writes the selected reel stop positions to reel control mechanism 48. Reel control mechanism 48 sets the reels into motion with a motor (not shown). The reels 12–16 are allowed to spin for a short time, and then are stopped at the selected reel stop positions. Symbols 24 on each of the reels 12–16 corresponding to the selected reel stops are displayed at win line 28, and microprocessor 36 dispenses the payout (possibly zero) associated with the selected game outcome.

Figure 4:
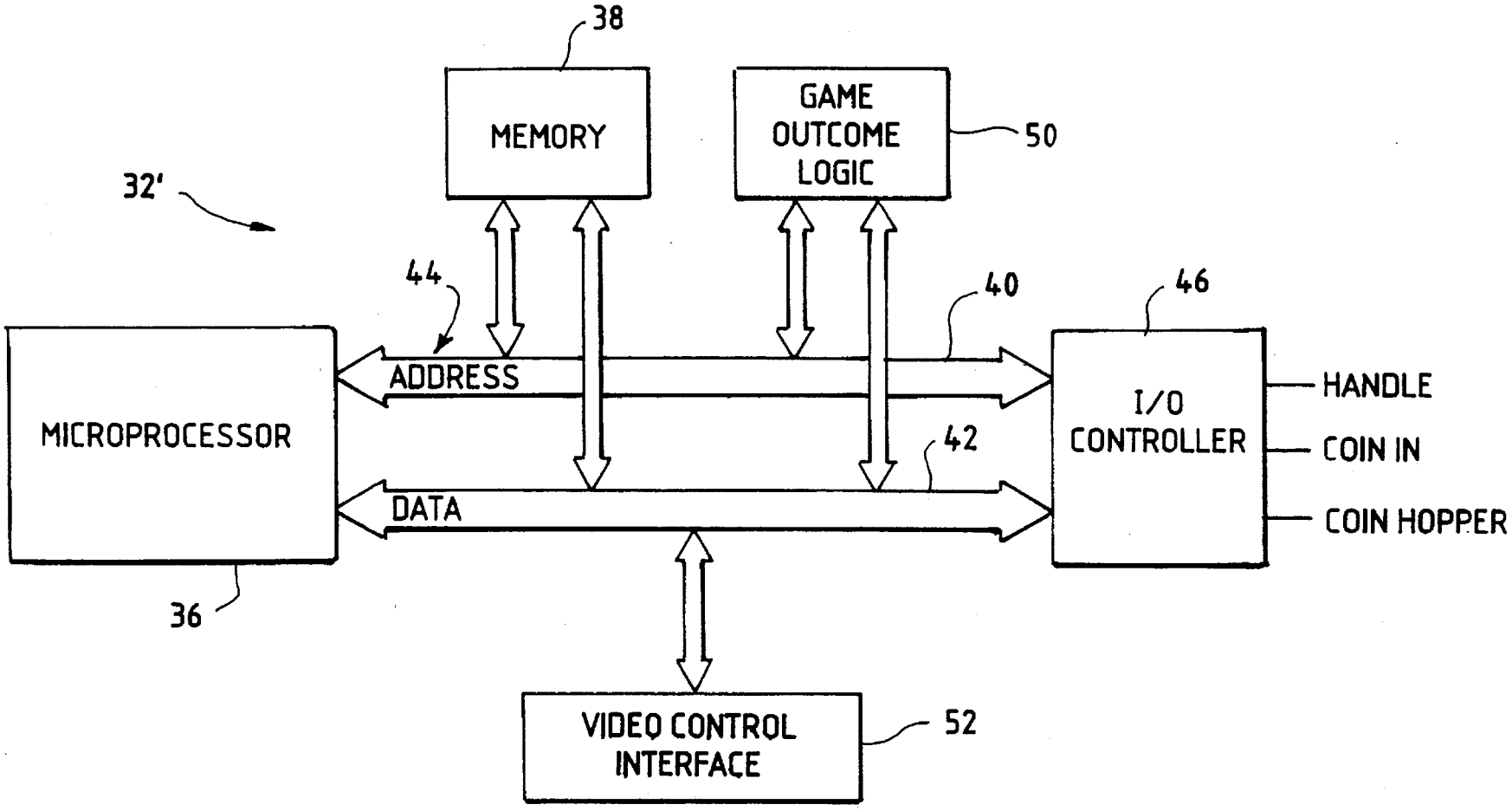
FIG. 4 is a block diagram of the electronic control system of FIG. 3 adapted for a video display slot machine.

It will be appreciated that the game outcome is determined by microprocessor 36 in cooperation with game outcome logic 50. The spinning reels 12–16 are used only to display the result. Thus, in lieu of physical reels 12–16, a video display can be used. FIG. 4 is a block diagram of an electronic control system 32' adapted for video displays. System 32' is comparable to system 32 of FIG. 3, except that in place of reel control mechanism 48, a video control interface 52 is provided. The interface allows microprocessor 36 to generate a video display of the game outcome displayed on a video screen (not shown). The video display is a representation of spinning reels.

Figure 5:
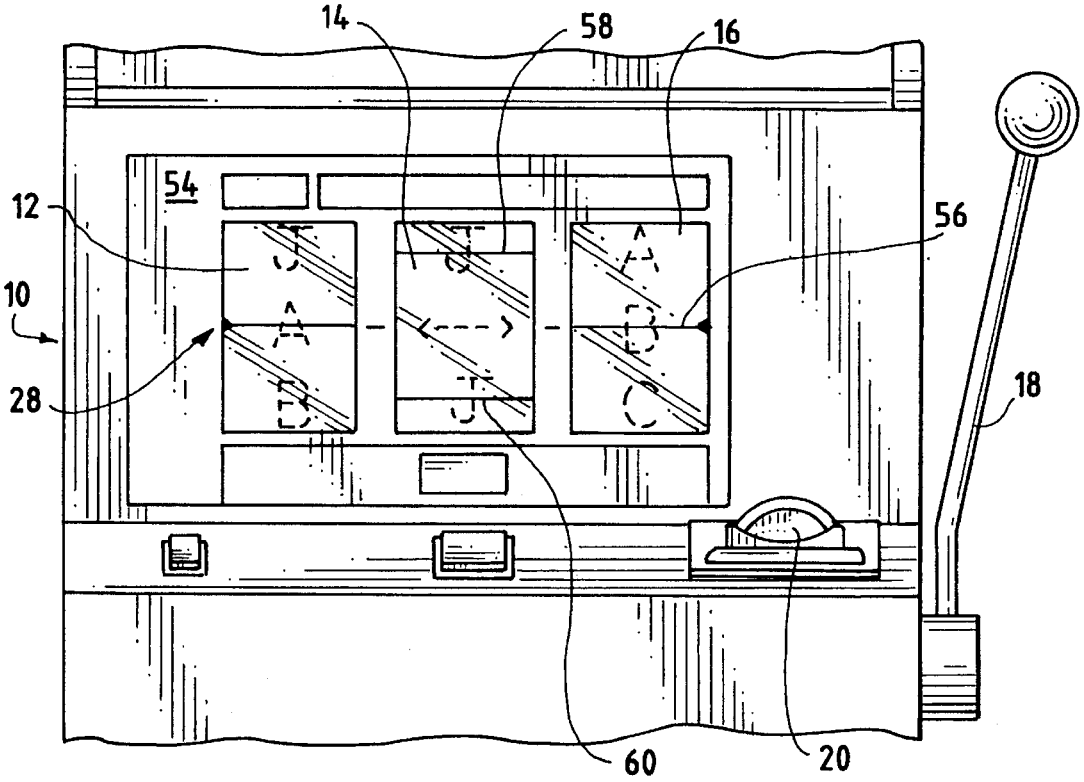
FIG. 5 is a partial front elevational view of the slot machine of FIG. 1 enlarged to more clearly show the win line in accordance with a first embodiment of the invention.

FIG. 5 is a partial front elevational view of slot machine 10 which has been enlarged to more clearly show win line 28 and reels 12–16. In FIG. 5, symbols are represented by block letters in phantom lines. It will be noted that reels 12, 14 and 16 are located behind a face glass 54, on which win line 28 is painted or impressed. Win line 28 is composed of a middle indicating portion 56, an upper indicating portion 58 and a lower indicating portion 60. Middle indicating portion 56 is adjacent each of reels 12–16. When reels 12–16 are stationary, middle indicating portion 56 is visually associated with one symbol from each reel.

Upper and lower indicating portions 58 and 60, respectively, are spaced apart parallel line segments, and are adjacent center reel 14. When center reel 14 is stationary, upper indicating portion 58 is visually associated with a symbol from reel 14, and lower indicating portion 60 is visually associated with another symbol from reel 14. Thus, despite the fact that there are only three reels 12, 14 and 16, the single displayed game outcome consists of five symbols, including three symbols from reel 14. On a gaming machine having at least four reels, one indicating portion can be associated with all of the reels, while two indicating portions are each associated with only two of the reels.

Figure 6:
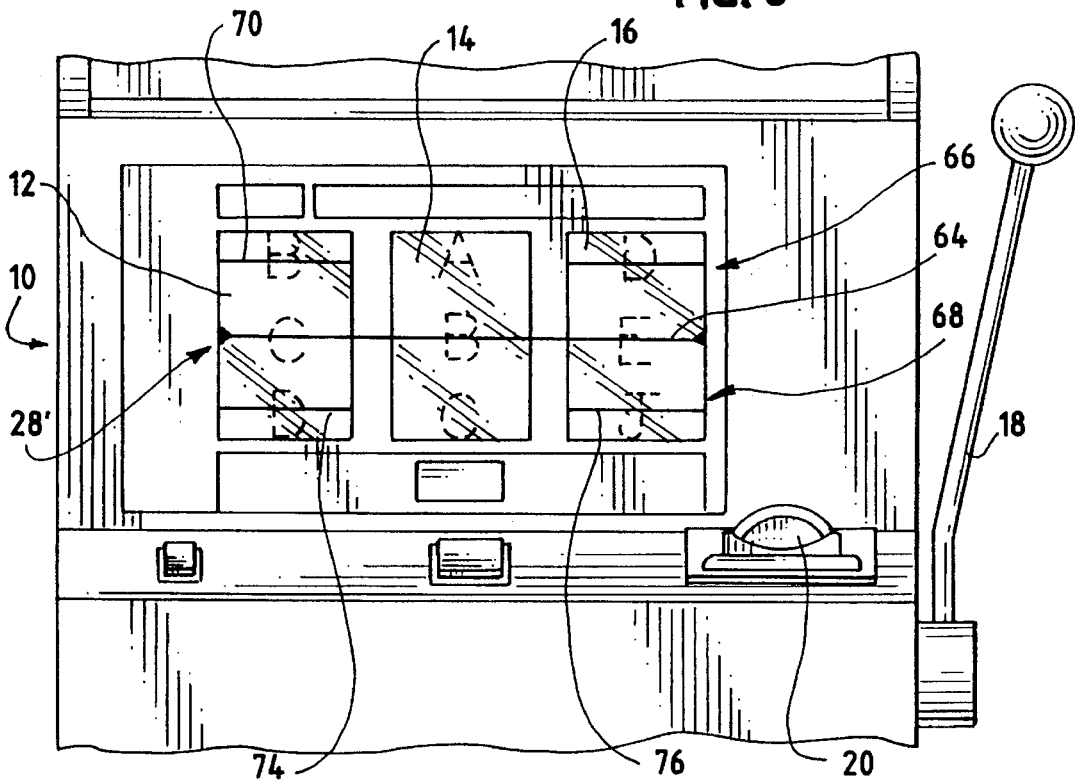
FIG. 6 is a partial front elevational view of the slot machine of FIG. 1 enlarged to illustrate a win line in accordance with a second embodiment of the invention.

FIG. 6 is a partial front elevational view of slot machine 10 which has been enlarged to illustrate a win line 28' in accordance with a second embodiment of the invention. Here, win line 28' is composed of a middle indicating portion 64, an upper indicating portion 66 and a lower indicating portion 68. Middle indicating portion 64 extends across all three reels 12–16. When reels 12–16 are stationary, middle indicating portion 64 is visually associated with one symbol from each of reels 12–16.

Upper indicating portion 66 consists of spaced apart line segments 70 and 72 which extend over left and right reels 12 and 16, but do not extend over center reel 14. Lower indicating portion 68 also consists of spaced apart line segments 74 and 76, which span left and right reels 12 and 16, but not center reel 14. When left reel 12 is stationary, upper indicating portion 66 is visually associated with a symbol from reel 12, and lower indicating portion 68 is visually associated with another symbol from reel 12. Likewise, when right reel 16 is stationary, upper indicating portion 66 is visually associated with a symbol from right reel 16, and lower indicating portion 68 is visually associated with another symbol from reel 16. Thus, despite the fact that there are only three reels 12–16, the displayed game outcome consists of seven symbols, including three symbols from each of the left and right reels 12 and 16, and one symbol from center reel 14.

Figures 7, 8:
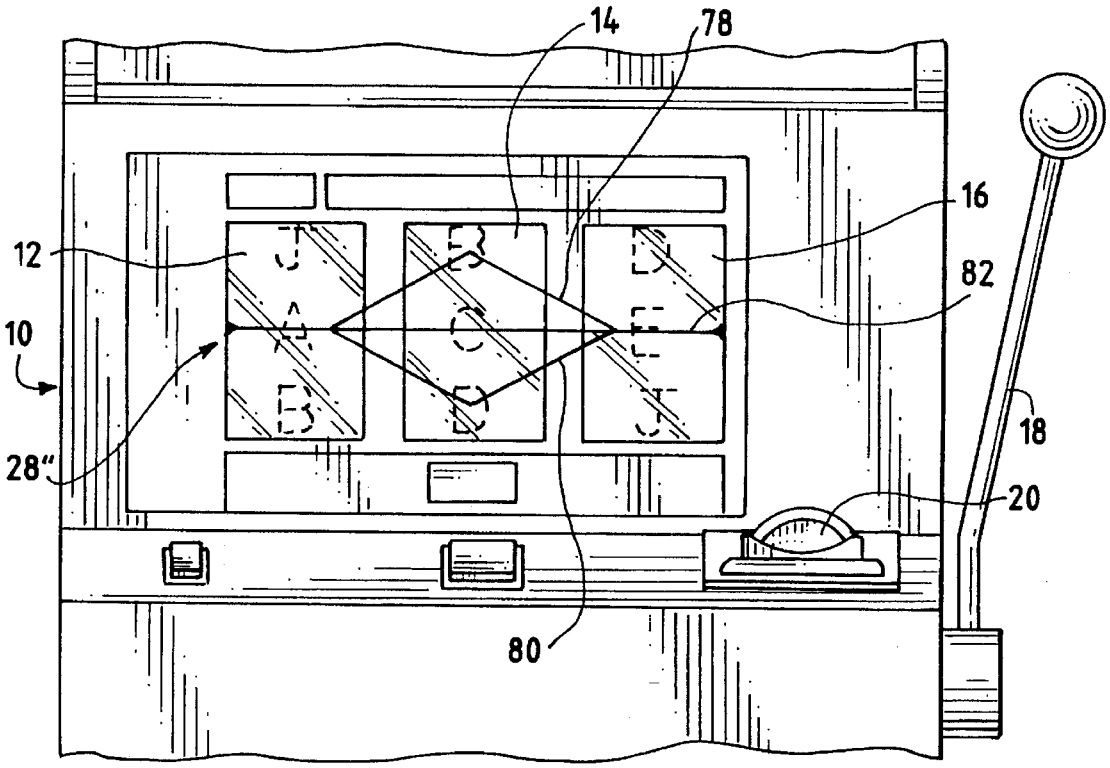
FIG. 7 is partial front elevational view of the slot machine of FIG. 1 enlarged to illustrate a win line in accordance with a third embodiment of the invention.
FIG. 8 is a table illustrating how symbols could be arranged on a reel in accordance with the invention.

FIG. 7 is a partial front elevational view of slot machine 10 enlarged to illustrate a win line 28" in accordance with a third embodiment of the invention. Win line 28" is functionally similar to win line 28 of FIG. 5. However, win line 28" illustrates that a win line in accordance with the invention may also incorporate nonfunctional features, such as ornamental or decorative features, or trademark features. In this case, upper and lower indicating portions 78 and 80 are angled to intersect middle indicating portion 82. While the visual impression of win line 28Δ differs from that of win line 28, the functionality is the same. That is, the game outcome consists of five symbols— three from center reel 14 and one each from left reel 12 and right reel 16.

FIG. 8 is a table 84 which illustrates how symbols could be arranged on a reel such as center reel 14. In this generalized example, the reel has eight reel stop positions (represented by numbers) and eight symbols (represented by letters or a blank). Although the invention can be implemented many different ways, we assume for this example that the configuration of FIG. 5 is used. Thus, center reel 14 is visually associated with middle indicating portion 56, upper indicating portion 58 and lower indicating portion 60. When reel 14 is stationary, three symbols along its periphery are aligned with indicating portions 56, 58 and 60, respectively.

To illustrate this, table 84 includes four columns: reel stop position column 86, upper symbol column 88, middle symbol column 90 and lower symbol column 92. For each reel stop position, columns 88–92 indicate which symbol is aligned with the middle, upper and lower indicating portions, 56-60, respectively. For example, at reel stop position one, upper indicating portion 58 is aligned with symbol "A," middle indicating portion 56 is aligned with symbol "B," and lower indicating portion 60 is aligned with symbol "C."

In this example, a special jackpot is paid when reel stop position six is selected as the game outcome. At reel stop position six, jackpot symbols "J" are aligned with both upper and lower indicating portions 58 and 60, and a blank space is aligned with middle indicating portion 56. Thus, the game outcome displayed by win line 28 on the center reel 14 has three symbols ("J", a blank and "J"). Because most players do not consider a blank as a "symbol" a lay person might think of the foregoing game outcome as having only two symbols displayed on reel 14.

It might seem that the use of a compound win line would create special complexities in programming microprocessor 36. Specifically, at first glance, it appears that microprocessor 36 must maintain in memory a table (such as shown in FIG. 8) showing which symbols are associated with which indicating portions at each reel stop. Fortunately, this is not always the case, because the relative positions of the symbols on a particular reel are typically fixed. Consequently, for a particular reel stop, the displayed symbols should always be the same. For example, as illustrated in FIG. 8, reel stop position six of reel 14 always displays "J" a blank and "J" along compound win line 28.

Thus, each combination of reel stop positions can be associated with a particular payout corresponding to the particular game outcome displayed by that combination of reel stop positions. Microprocessor 36 then selects reel stop positions in any conventional manner without regard to the fact that a compound win line is used. The probability weights for the reel stop positions can also be adjusted in any known manner in accordance with the size of the payout.

The compound win line of the present invention may also be used along with a traditional win line on the same machine. For example, on a three reel machine, a compound win line might be associated with four symbols, e.g., the middle symbol from the left reel, the middle symbol from the right reel and the upper and lower symbols from the center reel. Thus, a player could win by obtaining a winning combination of these four symbols. The slot machine might also include a second win line, e.g., a conventional horizontal win line that is associated with the middle symbol of each of the three reels. Thus, a player could win in a second way by obtaining a winning combination of these three symbols. Numerous other configurations are also possible.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A gaming machine, comprising:

a plurality of symbol-bearing reels;

a game outcome display area; and a win line defining a single winning game outcome positioned on said display area relative to said reels so that when said reels are stationary, at least one symbol that forms a part of a winning game outcome from each reel is visually associated with said win line to indicate a winning game outcome, wherein said win line includes at least two indicating portions so that at least two symbols that form a part of a winning game outcome from one of said reels are visually associated with said win line to indicate the winning game outcome wherein the required number of symbols on said win line is at least one greater that the number of reels.

2. The gaming machine of claim 1 wherein said win line includes at least three indicating portions, the first indicating portion associated with all of said reels, the second and third indicating portions each associated with less than all of said reels.

3. The gaming machine of claim 2 wherein said plurality of reels comprises at least three reels and said second and third indicating portions are each associated with only one of said reels.

4. The gaming machine of claim 3 having three reels arranged left, right and center, wherein said second and third indicating portions are each associated with said center reel.

5. The gaming machine of claim 4 wherein said three indicating portions are arranged upper, middle and lower, with said second indicating portion being upper, and said third indicating portion being lower.

6. The gaming machine of claim 2 wherein said plurality of reels comprises at least four reels, and said second and third indicating portions are each associated with only two of said reels.

7. A gaming machine, comprising:

a win line having a plurality of indicating portions and defining a single winning game outcome;

game display means for displaying a plurality of progressions of symbols along said win line indicating portions, wherein the combination of those symbols from each of the progressions which are visually associated with said win line define a displayed winning game outcome; and wherein at least two of said win line indicating portions are associated with the same one of the progressions of symbols, said at least two indicating portions being spaced apart to indicate at least two separate symbols of the progression, so that the displayed game outcome includes at least two symbols from the same progression, wherein the required number of symbols on said win line is at least one greater than the number progressions.

8. The gaming machine of claim 7 wherein said game display means includes a plurality of symbol-bearing reels, and each of the progressions is the sequence of symbols displayed as a particular reel rotates.

9. The gaming machine of claim 8 wherein said win line includes at least three indicating portions, the first indicating portion associated with all of said reels, the second and third indicating portions each associated with less than all of said reels.

10. The gaming machine of claim 9 wherein said plurality of reels comprises at least three reels, and said second and third indicating portions are each associated with only one of said reels.

11. The gaming machine of claim 10 having three reels-arranged left, right and center, wherein said second and third indicating portions are each associated with said center reel.

12. The gaming machine of claim 7 wherein said game display means includes a video display which displays the progressions.

13. The gaming machine of claim 12 wherein the progressions are displayed as facsimiles of spinning reels.

14. The gaming machine of claim 7 wherein said win line includes at least three indicating portions, the first indicating portion associated with all of the progressions, the second and third indicating portions each associated with less than all of the progressions.

15. The gaming machine of claim 14 having at least three progressions, wherein said second and third indicating portion lines are each associated with only one progression.

16. The gaming machine of claim 15 having three progressions, which are arranged left, right and center, wherein said second and third indicating portions are each associated with the center progression.

17. A method for indicating a winning game outcome in a gaming machine, comprising the steps of:

providing a win line defining a single winning game outcome and having a plurality of indicating portions;

rotating a plurality of symbol-bearing reels so that the symbols from each reel sequentially pass the win line; and halting rotation of the reels so that at least one symbol that forms a part of a winning game outcome from each reel, and two symbols that forms a part of winning game outcome from at least one reel, are visually associated with the win line, wherein the required number of symbols on said win line is at least one greater than the number of reels.

* * * * *